US012006084B2

(12) United States Patent
Meyers et al.

(10) Patent No.: US 12,006,084 B2
(45) Date of Patent: Jun. 11, 2024

(54) DRILL BIT PACKAGING

(71) Applicant: MILWAUKEE ELECTRIC TOOL CORPORATION, Brookfield, WI (US)

(72) Inventors: Glenn Meyers, Greenfield, WI (US); Aaron J. Duch, Elm Grove, WI (US); Brandon Kannel, Plum City, WI (US); Matthew J. Erickson, Waukesha, WI (US); Milorad Marich, Mequon, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/205,412

(22) Filed: Mar. 18, 2021

(65) Prior Publication Data

US 2022/0297865 A1 Sep. 22, 2022

(51) Int. Cl.

| | |
|---|---|
| ***B65B 51/22*** | (2006.01) |
| ***B65B 5/06*** | (2006.01) |
| ***B65D 75/32*** | (2006.01) |
| ***B65D 85/20*** | (2006.01) |

(52) U.S. Cl.

CPC ..... *B65B 51/22* (2013.01); *B65B 5/06* (2013.01); *B65D 75/32* (2013.01); *B65D 75/322* (2013.01); *B65D 85/20* (2013.01)

(58) Field of Classification Search

CPC ..... B65D 75/32; B65D 75/322; B65D 85/20; B65D 75/005; B65D 73/0064; B65D 73/0014

USPC ..... 206/349–383, 1.5

See application file for complete search history.

(56) References Cited

U.S. PATENT DOCUMENTS

| | | | | |
|---|---|---|---|---|
| 3,404,774 | A * | 10/1968 | Levine | B65D 73/0014 206/464 |
| 3,880,285 | A * | 4/1975 | March | B65D 75/36 229/406 |
| 4,019,632 | A | 4/1977 | Greenlee | |
| 4,450,961 | A | 5/1984 | Bies et al. | |
| 5,595,294 | A | 1/1997 | McKenzie et al. | |
| 5,906,350 | A * | 5/1999 | Kao | B65D 73/0064 206/349 |

(Continued)

FOREIGN PATENT DOCUMENTS

| | | |
|---|---|---|
| CN | 202020129 U | 11/2011 |
| DE | 1949700 U | 11/1966 |

(Continued)

OTHER PUBLICATIONS

International Search Report and Written Opinion for Application No. PCT/US2020/037409 dated Sep. 21, 2020 (11 pages).

(Continued)

*Primary Examiner* — Chun Hoi Cheung

(74) *Attorney, Agent, or Firm* — Michael Best & Friedrich LLP

(57) ABSTRACT

A packaging assembly for a drill bit. The packaging assembly includes a front clip including a front side, a rear side opposite the front side, a drill bit holding region configured to receive a portion of the drill bit, and a post extending from the drill bit holding region. The packaging assembly also includes a back clip that is separate from the front clip. The back clip includes an aperture that receives the post. The post includes an enlarged, melted head to inhibit removal of the back clip from the front clip.

13 Claims, 14 Drawing Sheets

(56) References Cited

U.S. PATENT DOCUMENTS

| | | | | |
|---|---|---|---|---|
| 6,152,299 | A | 11/2000 | O'Malley et al. | |
| 6,241,092 | B1 | 6/2001 | Vasudeva | |
| 6,283,311 | B1 * | 9/2001 | Lee | B25H 3/04 211/70.6 |
| 6,315,119 | B1 | 11/2001 | Lee | |
| 6,637,591 | B2 | 10/2003 | Chen | |
| 6,679,379 | B1 * | 1/2004 | Kao | A47F 7/024 206/349 |
| 6,837,373 | B2 * | 1/2005 | Huang | A45F 5/021 206/480 |
| 6,854,594 | B2 | 2/2005 | Vasudeva et al. | |
| 7,392,902 | B2 | 7/2008 | Chang | |
| 7,416,082 | B2 | 8/2008 | Roesler | |
| 8,186,512 | B2 * | 5/2012 | Bertken | B65D 73/005 206/488 |
| 8,336,710 | B2 * | 12/2012 | Chang | B65D 73/0064 206/349 |
| 8,443,972 | B1 | 5/2013 | Pendergraph et al. | |
| 8,556,074 | B2 * | 10/2013 | Turner | A61B 90/98 206/339 |
| 8,919,552 | B2 | 12/2014 | Pendergraph et al. | |
| 9,073,202 | B2 * | 7/2015 | Wang | B25H 3/00 |
| 9,387,972 | B1 * | 7/2016 | Wang | B65D 73/0064 |
| 9,550,615 | B2 * | 1/2017 | Miller | B65D 73/0014 |
| 10,894,645 | B2 | 1/2021 | Vagnoni et al. | |
| 2005/0061757 | A1 * | 3/2005 | Chiang | B65D 73/0064 211/70.6 |
| 2005/0067307 | A1 * | 3/2005 | Kao | B65D 73/0064 206/349 |
| 2005/0098462 | A1 * | 5/2005 | Hernandez | B65D 73/0064 206/349 |
| 2007/0080086 | A1 | 4/2007 | Dreps | |
| 2007/0228240 | A1 | 10/2007 | Kao | |
| 2013/0062240 | A1 | 3/2013 | Trontel et al. | |
| 2015/0114862 | A1 * | 4/2015 | Hu | B65D 73/0064 206/349 |
| 2015/0209956 | A1 | 7/2015 | Hu | |
| 2016/0288971 | A1 * | 10/2016 | Ou | B25H 3/003 |
| 2018/0354693 | A1 | 12/2018 | Vagnoni et al. | |

FOREIGN PATENT DOCUMENTS

| | | | |
|---|---|---|---|
| DE | 2245496 | A1 | 3/1974 |
| DE | 8517006 | U1 | 12/1986 |
| DE | 3530115 | A1 | 3/1987 |
| DE | 8524148 | U1 | 12/1987 |
| DE | 3807208 | A1 | 9/1989 |
| DE | 3819360 | A1 | 12/1989 |
| DE | 9203009 | U1 | 4/1992 |
| DE | 4207204 | A1 | 9/1993 |
| DE | 9313433 | U1 | 11/1993 |
| DE | 9407466 | U1 | 7/1994 |
| DE | 20008259 | U1 | 8/2000 |
| DE | 20020389 | U1 | 2/2001 |
| DE | 20112936 | U1 | 10/2001 |
| DE | 20303517 | U1 | 8/2003 |
| DE | 202004005388 | U1 | 9/2005 |
| DE | 19827747 | B4 | 3/2007 |
| EP | 0609522 | B1 | 5/1997 |
| EP | 0693436 | B1 | 3/1998 |
| EP | 1035031 | A2 | 9/2000 |
| EP | 1103482 | A2 | 5/2001 |
| EP | 2505515 | B1 | 4/2015 |
| IN | 201042335 | Y | 4/2008 |
| WO | 1993009040 | A1 | 5/1993 |
| WO | 1994004323 | A1 | 3/1994 |
| WO | 02090207 | A1 | 11/2002 |

OTHER PUBLICATIONS

Extended European Search Report for Application No. 20826060.4 dated May 16, 2023 (7 pages).

* cited by examiner

DRILL BIT PACKAGING

BACKGROUND OF THE INVENTION

The present application relates to drill bits and, in particular, to packaging for drill bits.

Drill bits are generally used with power tools such as rotary drills or hammer-type drills to cut or carve holes into a material or surface. Carbide tipped drill bits are becoming more popular for their improved cutting tip hardness. The carbide cutting tips of the drill bits should be protected before being used. For instance, the drill bits should be protected when on display in a store.

SUMMARY

In one aspect, the invention provides a packaging assembly for a drill bit. The packaging assembly includes a front clip with a front side, a rear side opposite the front side, a drill bit holding region configured to receive a portion of the drill bit, and a post extending from the drill bit holding region. The packaging assembly also includes a back clip that is separate from the front clip. The back clip includes an aperture that receives the post. The post includes an enlarged, melted head to inhibit removal of the back clip from the front clip.

In another aspect, the invention provides, a packaging assembly for a drill bit. The packaging assembly includes a first clip with a front side, a rear side opposite the front side, and an aperture extending through the front and rear sides. The packaging assembly also includes a second clip that is separate from the first clip with a front side, a rear side opposite the front side, and a post extending from the front side. The post is received by the aperture. The post includes an enlarged, melted head to inhibit removal of the first clip from the second clip and secure the drill bit between the first and second clips.

In another aspect, the invention provides, a method of assembling a packaging assembly for a drill bit. The method includes providing a first clip with a drill bit holding region to receive a portion of the drill bit and a second clip that is separate from the first clip. The at least a portion of the first clip being composed of plastic. The method also includes positioning the second clip over the drill bit holding region to hold the drill bit between the first and second clips, applying localized vibration to a portion of the first clip to create a pool of molten plastic, and cooling the pool of molten plastic to secure the first clip to the second clip.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
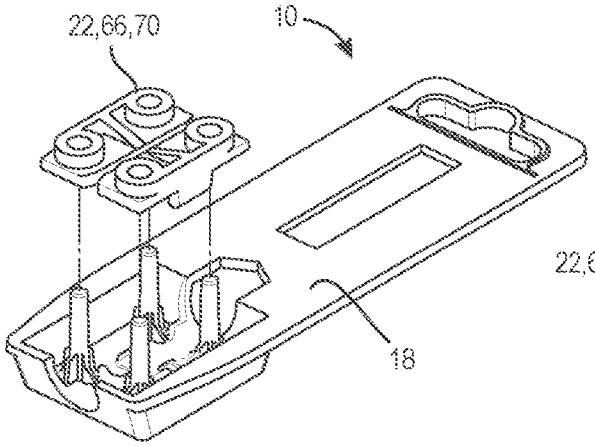
FIG. 1 is an exploded view of a packaging assembly.
Figure 2:
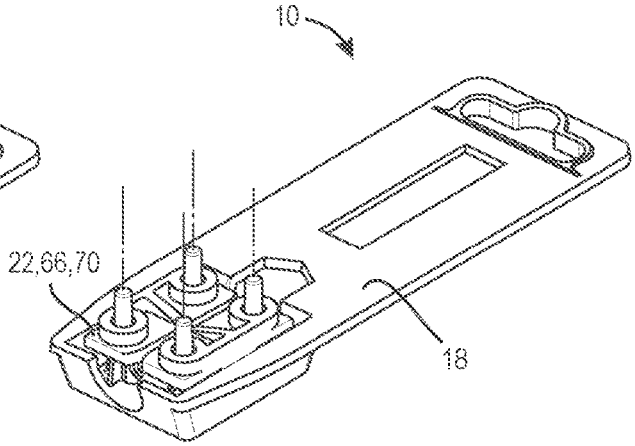
FIG. 2 is a perspective view of the packaging assembly of FIG. 1 when assembled.
Figure 12:
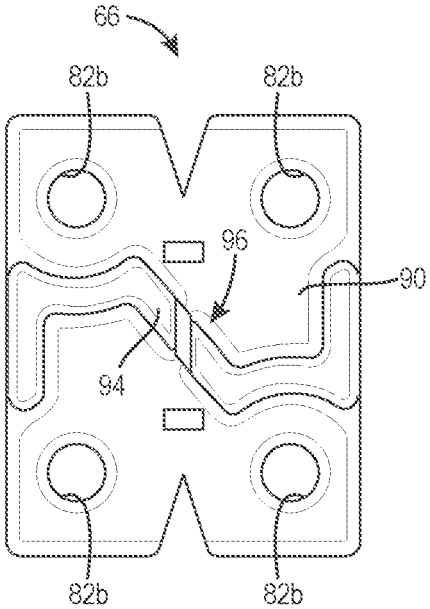
FIG. 12 is a rear view of the second back clip of FIG. 9.
Figure 13:
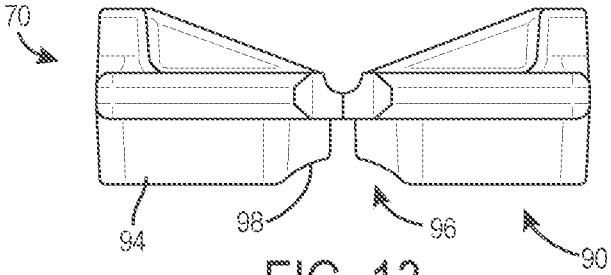
FIG. 13 is a side view of the second back clip of FIG. 9.

FIGS. 1 and 2 illustrate a packaging assembly 10 for a drill bit 14 (FIG. 12). The drill bit 14 may, for example, be used with power tools such as a drill, a driver drill, a screwdriver, and the like. The drill bit 14 may be used to cut holes or drill into a workpiece made out of brick, block, tile, metal, marble, concrete, plaster, wood, plastic, dry-wall, and the like. The drill bit 14 may include a carbide tip, which improves the durability and cutting ability of the drill bit 14. In some embodiments, the drill bit 14 may be a slotted drive system (SDS) bit, an SDS Plus bit, or an SDS Max bit. In other embodiments, the drill bit 14 may have other configurations, such as a hex shank, shank with flats, round shank, etc. The drill bit 14 may come in a variety of sizes that correspond to the diameter of a hole to be created in a workpiece. For example, possible sizes of the drill bit 14 may be 3 mm, 6 mm, 9 mm, and 13 mm. In further embodiments, the drill bit 14 may be ⅛", ¼", ½", or the like. In the illustrated embodiments, the drill bit 14 may be in a first size range that extends between 5/32" and 5/16" or a second size range that extends between ⅜" and ½". In other embodiments, the drill bit 14 may be other sizes, including sizes greater than ½".

Figure 3:
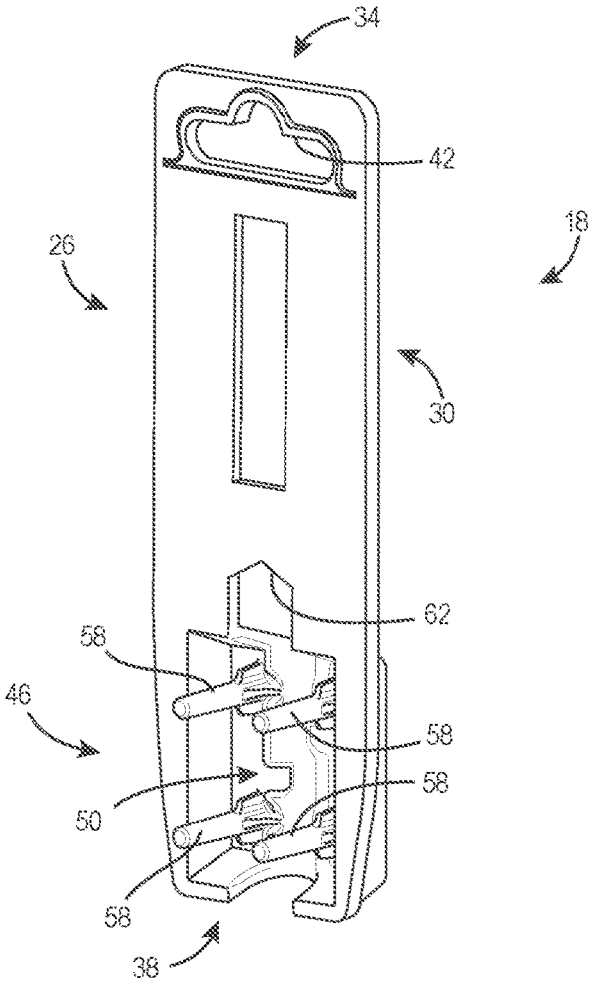
FIG. 3 is a rear perspective view of a front clip of the packaging assembly.
Figure 4:
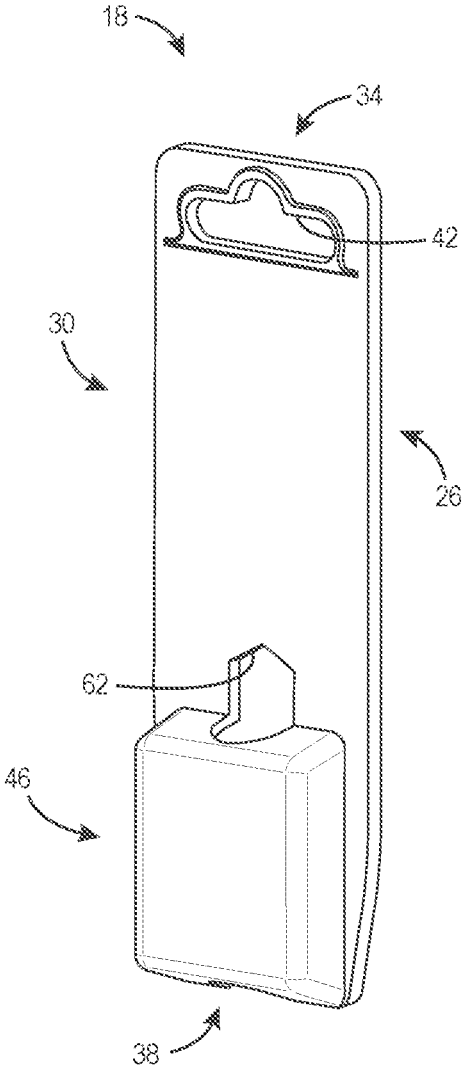
FIG. 4 is a front perspective view of a front clip of FIG. 3.

The illustrated packaging assembly 10 includes a front clip 18 and a back clip 22. Together, the front clip 18 and the back clip 22 surround the drill bit 14 to protect the carbide tip. As shown in FIGS. 3 and 4, the front clip 18 includes a rear side 26, a front side 30 opposite the rear side 26, a top side 34, and a bottom side 38 opposite the top side 34. An aperture 42 adjacent the top side 34 extends between the rear side 26 and the front side 30 of the front clip 18. The aperture 42 is configured to support the packaging assembly 10 from a hook. For example, the aperture 42 may support the packaging assembly 10 on display within a retail store where the drill bit 14 may be sold.

Figure 5:
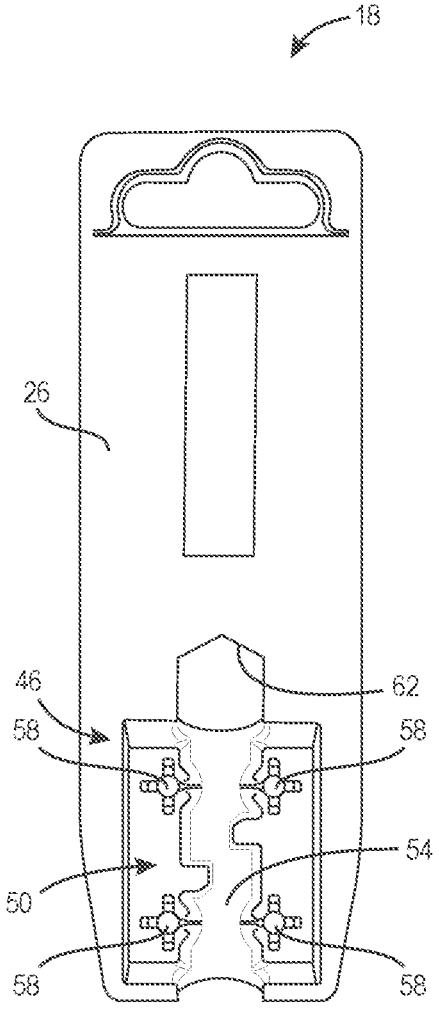
FIG. 5 is a rear view of the front clip of FIG. 3.
Figure 6:
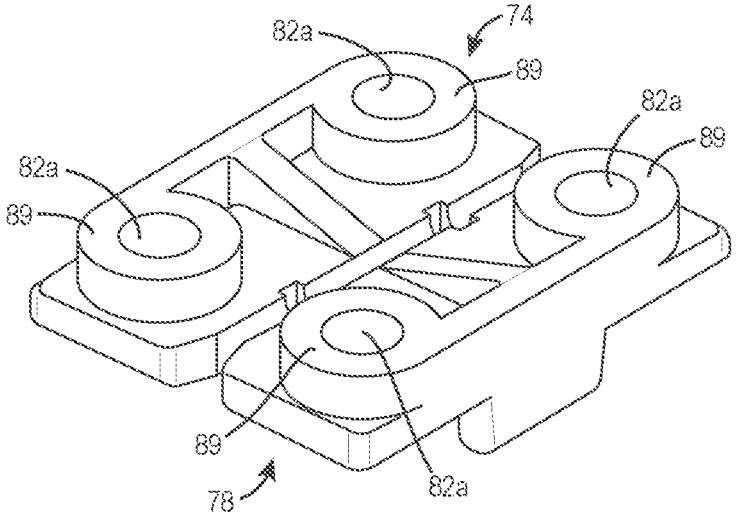
FIG. 6 is a perspective view of a first back clip of the packaging assembly of FIG. 1.
Figure 7:
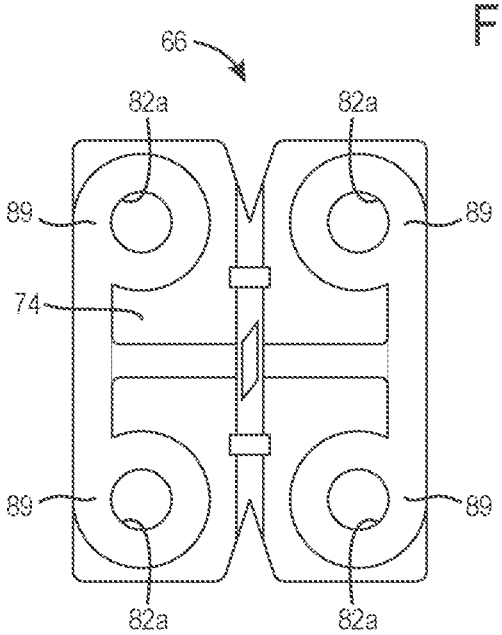
FIG. 7 is a front view of the first back clip of FIG. 6.
Figure 8:
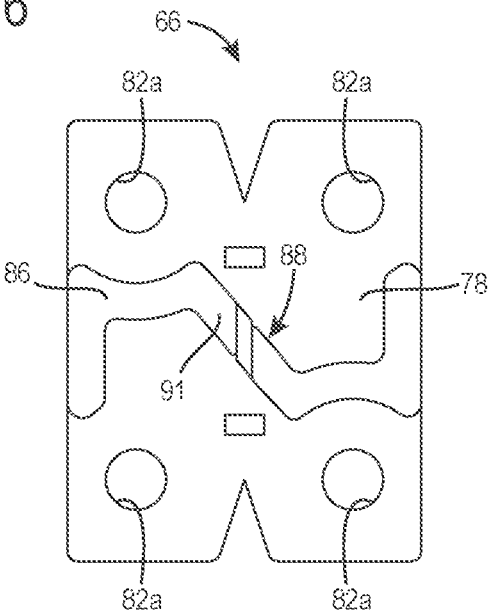
FIG. 8 is a rear view of the first back clip of FIG. 6.
Figure 9:
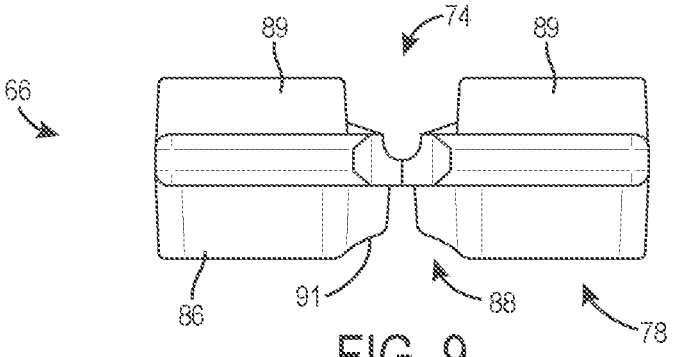
FIG. 9 is a side view of the first back clip of FIG. 6
Figure 10:
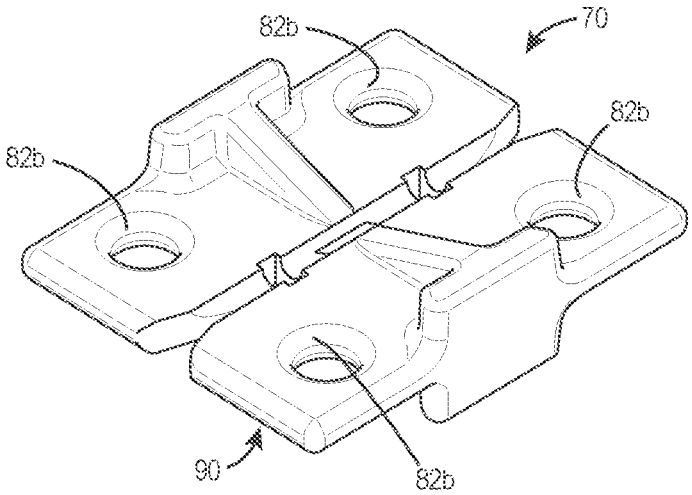
FIG. 10 is a perspective view of a second back clip of the packaging assembly of FIG. 1.
Figure 11:
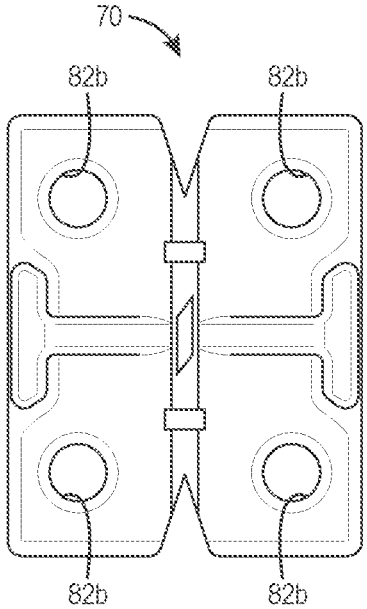
FIG. 11 is a front view of the second back clip of FIG. 9.

As shown in FIGS. 3-5, the front clip 18 includes a drill bit holding region 46. The drill bit holding region 46 protrudes from the front side 30 of the front clip 18 to define a recess 50 on the rear side 26 of the front clip 18. The drill bit holding region 46 includes a channel 54 and a plurality of posts 58 positioned in the recess 50. The channel 54 extends through the center of the drill bit holding region 46 from the bottom side 38 towards the top side 34 of the front clip 18. The posts 58 extend from the recess 50 and beyond the rear side 26 of the front clip 18. The front clip 18 further includes a window 62 that extends between the rear side 26 and the front side 30. The window 62 extends away from the drill bit holding region 46 in a longitudinal direction of the front clip 18. In other words, the window 62 is positioned above the drill bit holding region 46. The channel 54 extends into the window 62 in a longitudinal direction of the front clip 18 and allows for a user to see a tip of a drill bit 14 when the drill bit 14 is positioned in the channel 54 of the drill bit holding region 46. In the illustrated embodiment, the window 62 is an opening in the front clip 18. In other embodiments, the window 62 may include a clear material (e.g., plastic) that extends at least partially over the window 62, but still provides visibility to a drill bit contained with the drill bit holding region 46.

The back clip 22 may either be a first back clip 66 (FIGS. 6-9) or a second back clip 70 (FIGS. 10-13). The first back clip 66 may be used to protect drill bits within the first size range discussed above. The second back clip 70 may be used to protect drill bits that fall within the second size range. With reference to FIGS. 6-9, the first back clip 66 includes an exterior side 74, an interior side 78 opposite the exterior side 74, and a plurality of apertures 82*a* that extend from the interior side 78 to the exterior side 74. The interior side 78 includes a ridge 86 that may correlate to a flute or a cutting edge of a drill bit 14. The ridge 86 may extend into a flute to position and secure the drill bit 14 within the packaging assembly 10. Alternatively, the ridge 86 may contact or engage an outer surface of the drill bit 14. The ridge 86 defines a channel 88 (FIG. 9) that rests against the drill bit 14 when the packaging assembly 10 is assembled. The channel 88 correlates to the first size range of drill bits 14. In other words, the channel 88 defines an arcuate surface 91 having a first radius that correlates to drill bits 14 within the first size range. In the illustrated embodiment, the first back clip 66 includes four apertures 82*a*. Each of the four apertures 82*a* is linearly aligned with two adjacent apertures 82*a*. In other words, the apertures 82*a* are arranged in a rectangular pattern. The apertures 82*a* are sized to receive the posts 58 of the front clip 18 when the packaging assembly 10 is assembled. The exterior side 74 of the first back clip includes bosses 89 that surround the apertures 82*a*.

With reference to FIGS. 10-13, the second back clip 70 is similar to the first back clip 66. The second back clip 70 also includes a plurality of apertures 82*b*. An interior side 90 of the second back clip 70 includes a ridge 94 that may correlate to a flute or a cutting edge of the drill bit 14. The ridge 94 may extend into a flute to position and secure the drill bit 14 within the packaging assembly 10. Alternatively, the ridge 94 may contact or engage an outer surface of the drill bit 14. The ridge 94 defines a channel 96 (FIG. 13) that rests against the drill bit 14 when the packaging assembly 10 is assembled. The channel 96 correlates to the second size range of drill bits 14. In other words, the channel 96 defines an arcuate surface 98 having a second radius that correlates to the drill bits 14 within the second size range. Due to the first size range representing drill bits 14 with a smaller diameter than the drill bits 14 within the second size range, the channel 88 does not extend as deep into the ridge 86 as the channel 96 extends into the ridge 94 of the second back clip 70.

To assemble the packaging assembly 10, a drill bit 14 (see, for example, FIG. 14) is seated within the channel 54 of the drill bit holding region 46 of the front clip 18 with the tip of the drill bit 14 extending into the window 62. In some embodiments, a compressible member, such as foam, may also be placed on the channel 54 between the front clip 18 and the drill bit 14. In other embodiments, the compressible member may be omitted. Then, depending on the size of the drill bit 14, either the first back clip 66 or the second back clip 70 is coupled to the front clip 18. Specifically, if the drill bit 14 is within the first size range, the first back clip 66 is coupled to the front clip 18, and if the drill bit 14 is within the second size range, the second back clip 70 is coupled to the front clip 18. To couple either the first back clip 66 or the second back clip 70 to the front clip 18, the apertures 82*a*, 82*b* are aligned with the posts 58. The back clip 22, 66, 70 is then slid along the posts 58 until the back clip 22, 66, 70 contacts the rear side 26 of the front clip 18. If the first back clip 66 is used, due to the channel 88 accommodating smaller diameter drill bits 14, the first back clip 66 sits closer to the rear side 26 of the front clip 18. To minimize the distance the posts 58 extend from the apertures 82*a*, the bosses 89 cover a portion of the posts 58. If the second back clip 70 is used, due to the channel 96 accommodating larger diameter drill bits 14, the second back clip 70 sits further from the rear side 26 of the front clip 18. As such, the second back clip 70 does not need bosses to cover the posts 58.

Meanwhile, the ridge 86, 94 of the back clip 22, 66, 70 extends into a flute of the drill bit 14 or engages an outer surface of the drill bit 14 to secure the drill bit 14 in place. The back clip 22, 66, 70 is then ultrasonically welded to the posts 58 of the front clip 18. In other words, high-frequency ultrasonic acoustic vibrations are locally applied to the posts 58 and the back clip 22, 66, 70 to create a solid-state weld. In some embodiments, the drill bit 14 is additionally held in place with two zip ties that are manually wrapped around the drill bit 14.

Providing a packaging assembly 10 with a front clip 18 and either a first back clip 66 or a second back clip 70 advantageously provides protection for a large range of differently sized drill bits 14 without additionally components. Having only two back clips 22, 66, 70 to cover a full range of drill bit 14 sizes reduces the cost of manufacturing a packaging assembly 10.

Figure 14:
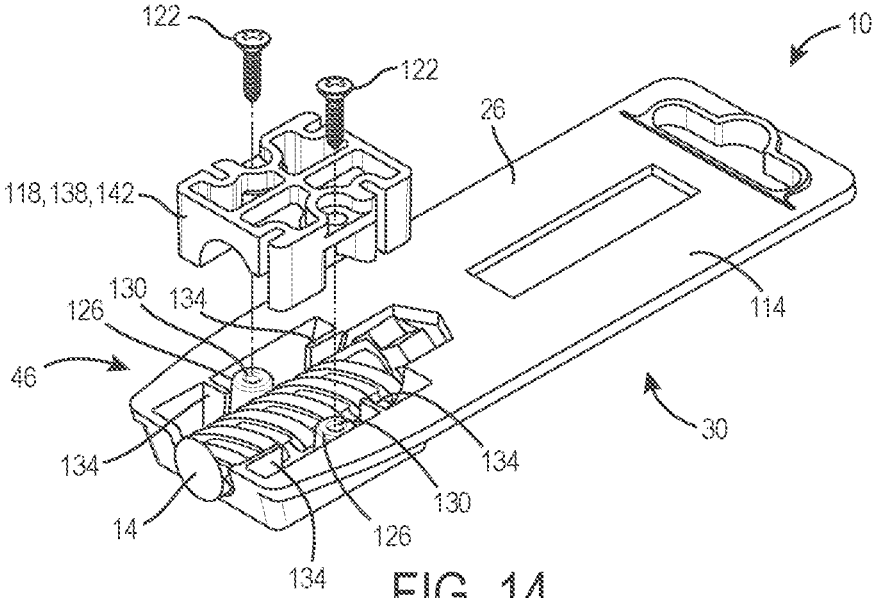
FIG. 14 is an exploded view of a packaging assembly according to another embodiment.

FIG. 14 illustrates a packaging assembly 110 according to another embodiment of the invention. The packaging assembly 110 is similar to the packaging assembly 10 described above, with like features being represented with like reference numerals. The packaging assembly 110 includes a front clip 114, a back clip 118, and screws 122 to couple the back clip 118 to the front clip 114.

The front clip 114 is similar to the front clip 18 described above, but includes a pair of posts 126 extending from the front side 30 towards the rear side 26 within the recess 50 of the drill bit holding region 46. Each of the posts 126 defines an opening 130. The interior of the posts 126 may include threads to receive a screw 122. In other embodiments, the interior of the posts 126 may be relatively smooth, and the screws 122 may form threads in the posts during assembly. The front clip 114 further includes a plurality of tabs 134 that help position the back clip 118 within the recess 50.

Figure 15:
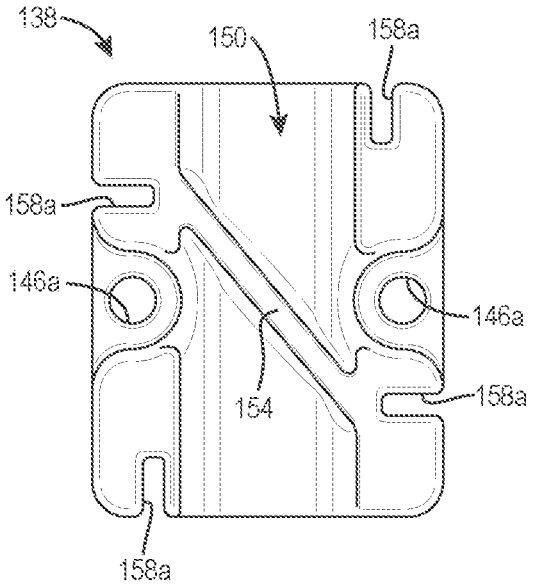
FIG. 15 is a rear view of a first back clip of the packaging assembly FIG. 14.
Figure 16:
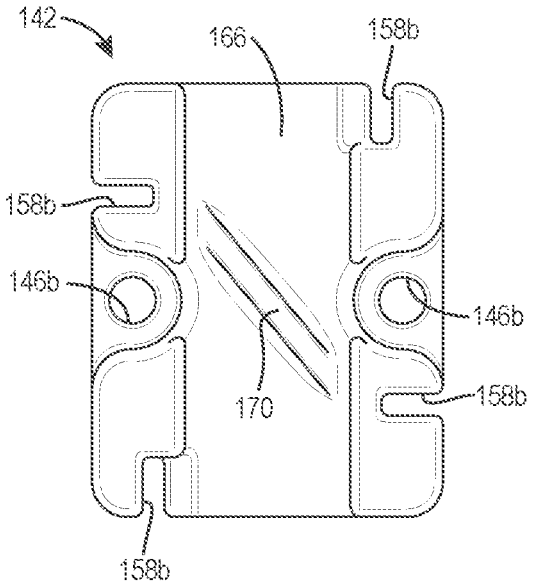
FIG. 16 is a rear view of a second back clip of the packaging assembly of FIG. 14.
Figure 17:
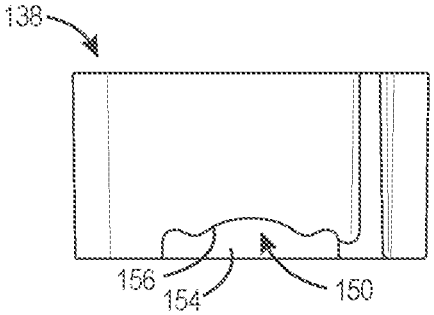
FIG. 17 is a side view of the first back clip of FIG. 15.
Figure 18:
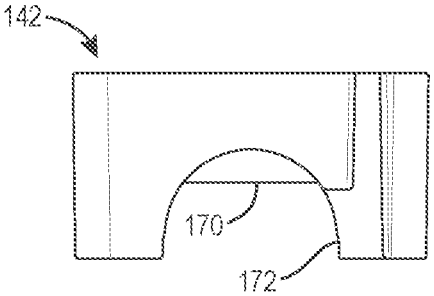
FIG. 18 is a side view of the second back clip of FIG. 16.

Similar to the back clip 22 described above, the back clip 118 may either be a first back clip 138 (FIGS. 15 and 17) or a second back clip 142 (FIGS. 16 and 18). The first back clip 138 may be used to secure drill bits 14 that fall within the first size range. The second back clip 142 may be used to secure drill bits that fall within the second size range. The first back clip 138 includes a pair of apertures 146*a* that extend through the first back clip 138. The first back clip 138 further defines a channel 150 with a ridge 154 that extends through the channel 150 at an oblique angle to correlate with a flute of a drill bit 14. The channel 150 defines an arcuate surface 156 having a first radius that correlates to the first size range of drill bits 14. In the illustrated embodiment, the first back clip 138 includes two apertures 146*a* that are on adjacent sides of the first back clip 138. The first back clip 138 further includes a plurality of notches 158*a* that correlate to the tabs 134 of the front clip 114.

The second back clip 142 is similar to the first back clip 138 and includes a plurality of apertures 146*b* and notches 158*b*. The second back clip 142 further defines a channel 166 with a ridge 170 that extends partially through the channel 166 at an oblique angle to correlate with a flute of a drill bit 14. The channel 166 defines an arcuate surface 172 having a second radius that correlates to the second size range of drill bits 14. The channel 166 extends deeper into the second back clip 142 than the channel 150 extends into the first back clip 138 to accommodate a drill bits 14 with larger diameters.

Assembly of the packaging assembly 110 is similar to the assembly of the packaging assembly 10 described above. A drill bit 14 is seated within the channel 54 of the drill bit holding region 46 of the front clip 114 with the tip end of the drill bit 14 extending into the window 62. Then, depending on the size of the drill bit 14, either the first back clip 138 or the second back clip 142 is coupled to the front clip 114. Specifically, if the drill bit 14 is within the first size range, the first back clip 138 is coupled to the front clip 114, and if the drill bit 14 is within the second size range, the second back clip 142 is coupled to the front clip 114. To couple either the first back clip 138 or the second back clip 142 to the front clip 114, the apertures 146*a*, 146*b* of the back clip 118, 138, 142 are aligned with the openings 130 of the posts 126. The back clip 118, 138, 142 is then positioned within the recess 50 of the drill bit holding region 46 with the tabs 134 extending into the notches 158*a*, 158*b* to secure the back clip 118, 138, 142 in place. Meanwhile, the ridge 154, 170 of the back clip 118, 138, 142 extends into a flute of the drill bit 14 or contacts an outer surface of the drill bit 14 to secure the drill bit 14 in place. Then, the screws 122 are inserted into the apertures 146*a*, 146*b* of the back clip 118, 138, 142 and tightened to further secure the back clip 118, 138, 142 around the drill bit 14. In the illustrated embodiment, the packaging assembly 110 includes two screws 122 that correlate to two posts 126. In other embodiments, the front clip 114 may include fewer or more than two posts 126, and the back clip 118, 138, 142 may include fewer or more apertures 146*a*, 146*b*. As such, the packaging assembly 110 may include fewer or more screws 122 to correlate to the apertures 146*a*, 146*b* and posts 126.

Figure 19:
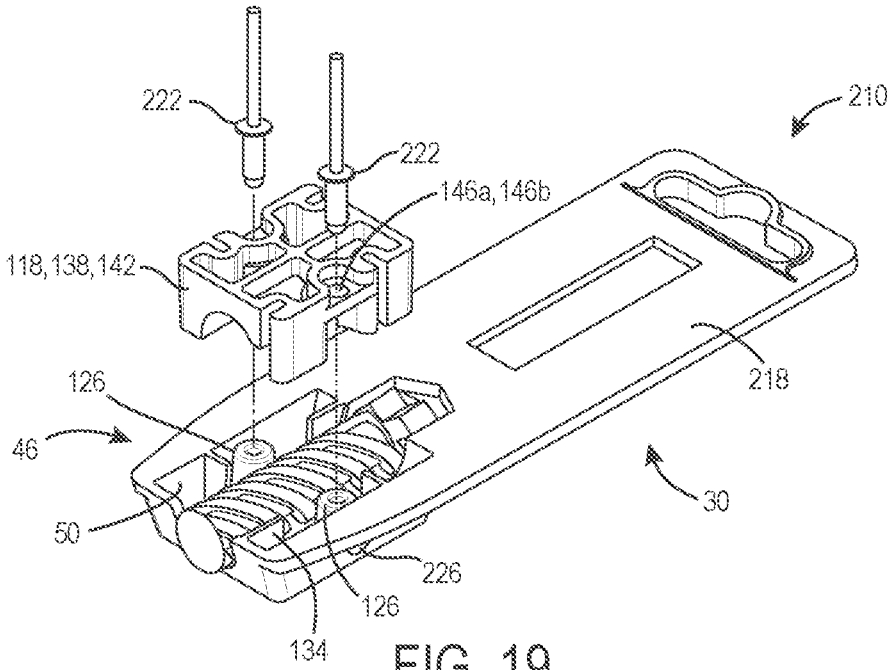
FIG. 19 is an exploded view of a packaging assembly according to another embodiment.
Figure 20:
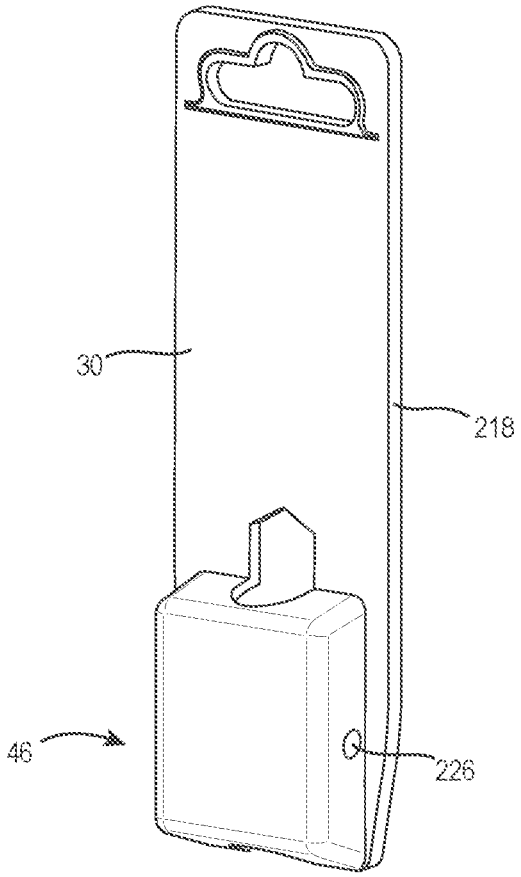
FIG. 20 is a perspective view of a front clip of the packaging assembly of FIG. 19.

FIG. 19 illustrates a packaging assembly 210 according to another embodiment of the invention. The packaging assembly 210 is similar to the packaging assembly 110 with like features being represented with like reference numerals. The packaging assembly 210 includes a front clip 218, the back clips 118, 138, 142 described above with reference to the packaging assembly 110, and rivets 222 to couple the front clip 218 to the back clip 118, 138, 142. As shown in FIG. 20, the front clip 218 is substantially the same as the front clip 114; however, the illustrated front clip 218 includes a pair of apertures 226 on the front side 30 that extend through the posts 126 and into the recess 50.

Assembly of the packaging assembly 210 is similar to the assembly of the packaging assembly 110 described above. Once the back clip 118, 138, 142 is positioned within the recess 50 of the front clip 218, the rivets 222 are inserted through the apertures 146*a*, 146*b* of the back clips 118, 138, 142 and into the openings 130 of the posts 126. A tool is then inserted through the apertures 226 in the front clip 218 to deform the rivets 222 and secure the back clip 118, 138, 142 to the front clip 218.

Figure 21:
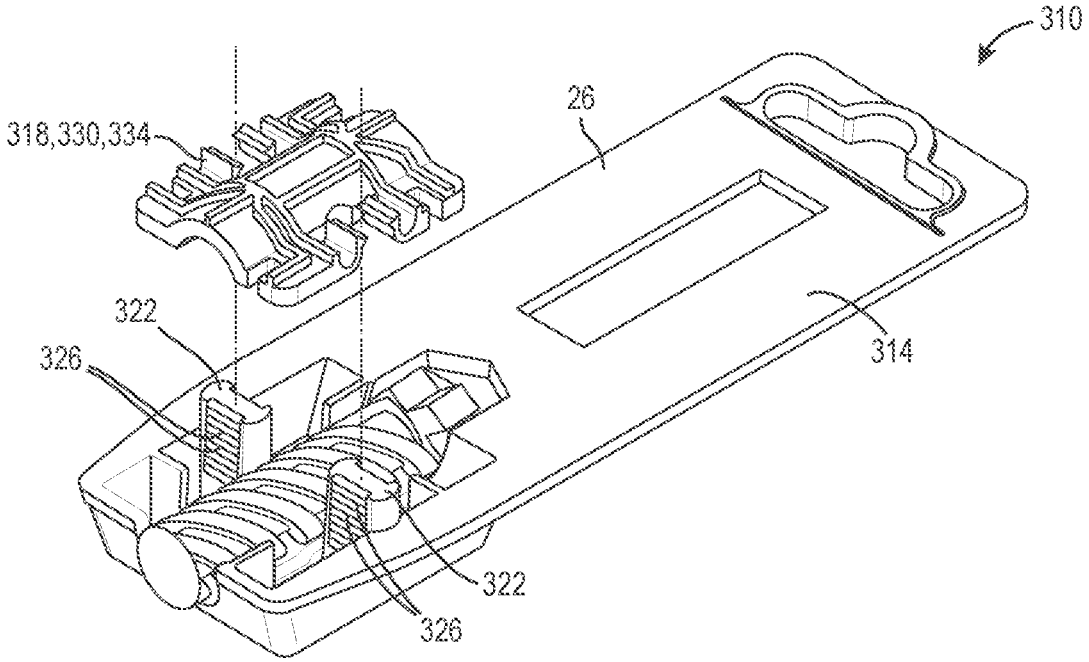
FIG. 21 is an exploded view of a packaging assembly according to another embodiment.
Figure 22:
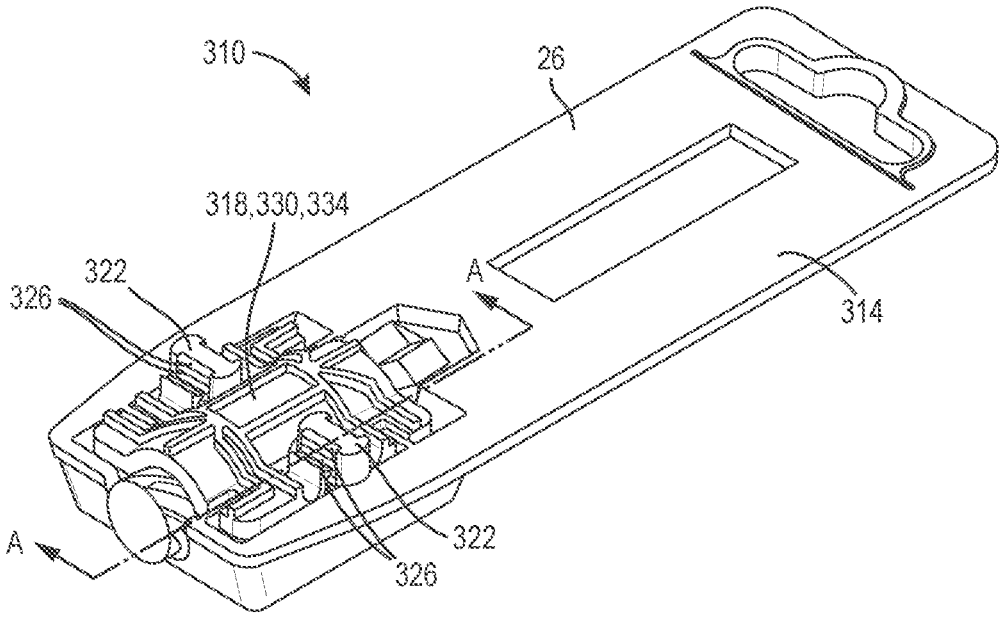
FIG. 22 is a perspective view of the packaging assembly of FIG. 21 when assembled.

FIGS. 21 and 22 illustrate a packaging assembly 310 according to another embodiment of the invention. The packaging assembly 310 is similar to the packaging assembly 110 with like features being represented with like reference numerals. The packaging assembly 310 includes a front clip 314 and a back clip 318.

The front clip 314 is similar to the front clip 114 described above, but includes a pair of posts 322 extending from the front side 30 towards the rear side 26 within the recess 50 of the drill bit holding region 46. The posts 322 extend beyond the rear side 26 of the front clip 314. Each of the posts 322 includes a plurality of ratchet teeth 326 on opposing sides of the post 322.

Figure 23:
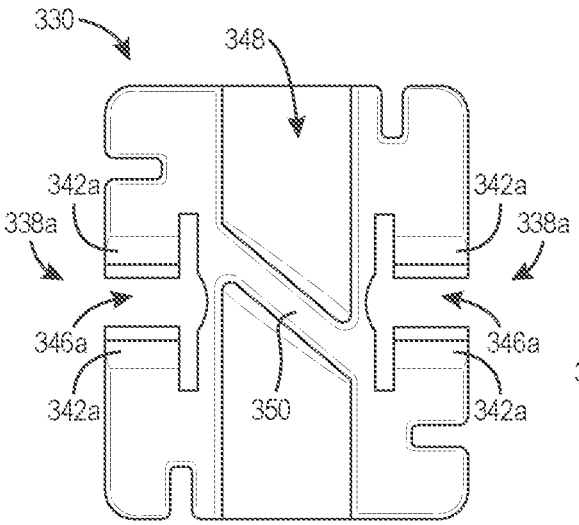
FIG. 23 is a rear view of a first back clip of the packaging assembly of FIG. 21.
Figure 24:
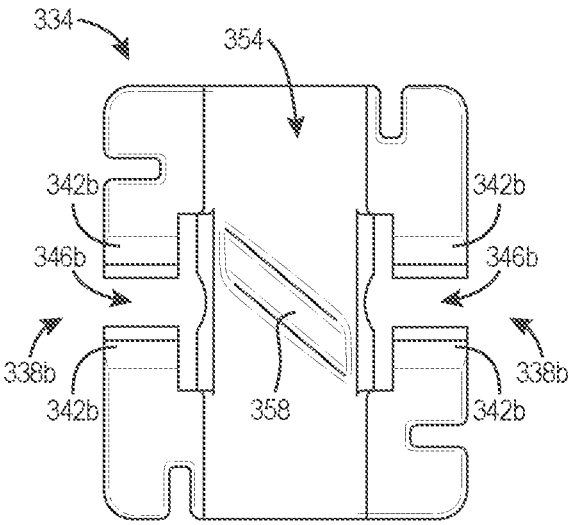
FIG. 24 is a rear view of a second back clip of the packaging assembly of FIG. 21.
Figure 25:
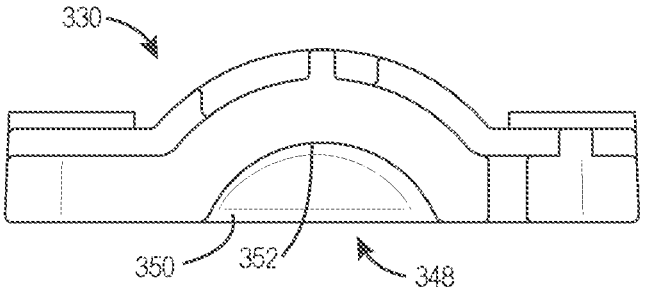
FIG. 25 is a side view of the first back clip of FIG. 23.
Figure 26:
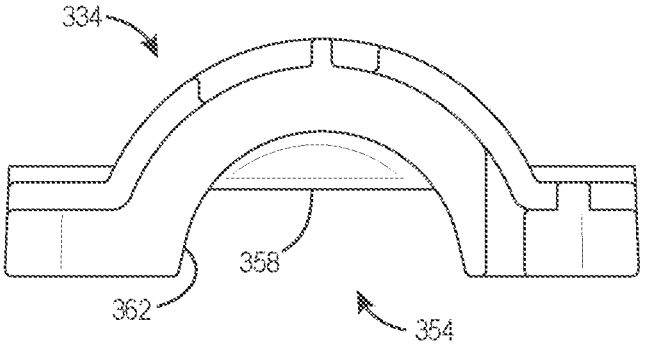
FIG. 26 is a side view of the second back clip of FIG. 24.

Similar to the back clip 118 described above, the back clip 318 may either be a first back clip 330 (FIG. 23) or a second back clip 334 (FIG. 24). The first back clip 330 may be used to protect drill bits 14 that fall within the first size range. The second back clip 334 may be used to protect drill bits 14 that fall within the second size range. The first back clip 330 includes a pair of pawls 338*a* on opposite sides. The pawls 338*a* are defined by two opposing tabs 342*a* that define an opening 346*a* between them that correlates to the posts 322. The first back clip 318 further defines a channel 348 with a ridge 350 that extends through the channel 348 at an oblique angle to correlate with a flute of a drill bit 14. The channel 348 defines an arcuate surface 352 having a first radius that correlates to the first size range of drill bits 14.

The second back clip 334 is similar to the first back clip 330 and also includes a pair of pawls 338*b* defined by two opposing tabs 342*b* that define an opening 346*b* between them that correlates to the posts 322. The second back clip 334 further defines a channel 354 with a ridge 358 that extends partially through the channel 354 at an oblique angle to correlate with a flute of a drill bit 14. The channel 354 defines an arcuate surface 362 having a second radius that correlates to the second size range of drill bits 14. The channel 354 extends deeper into the second back clip 334 than the channel 348 extends into the first back clip 330 to accommodate drill bits 14 with larger diameters.

Figure 27:
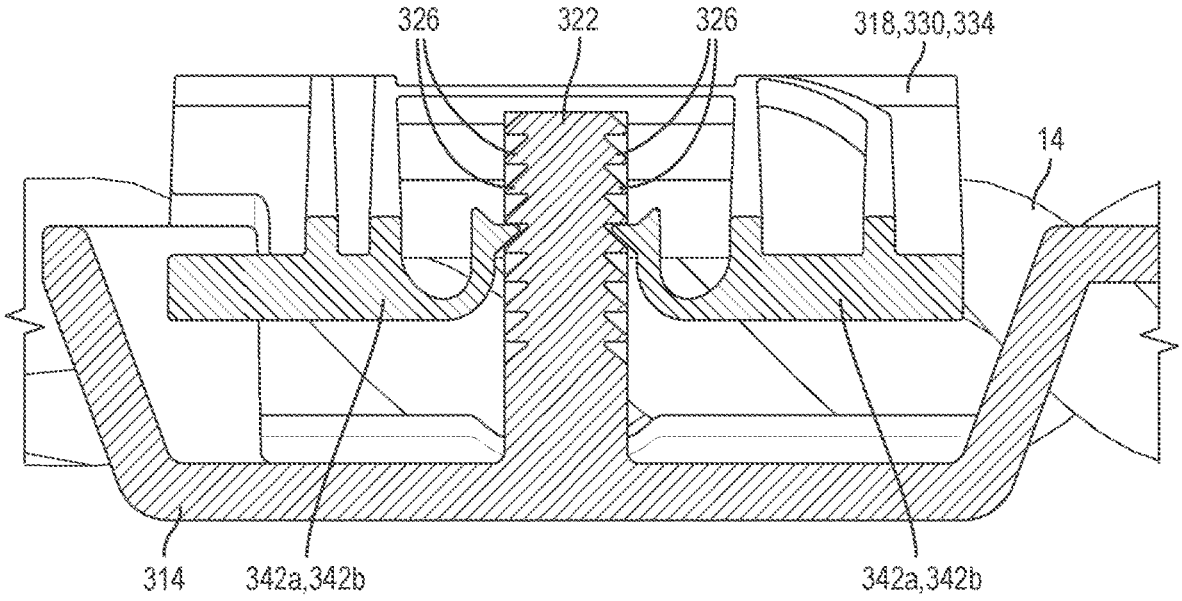
FIG. 27 is a cross-sectional view of the packaging assembly of FIG. 22 taken along lines A-A.

Assembly of the packaging assembly 310 is similar to the assembly of the packaging assembly 110 described above. A drill bit 14 is seated within the channel 54 of the drill bit holding region 46 of the front clip 314 with the tip end of the drill bit 14 extending into the window 62. Then, depending on the size of the drill bit 14, either the first back clip 330 or the second back clip 334 is coupled to the front clip 314. Specifically, if the drill bit 14 is within the first size range, the first back clip 330 is coupled to the front clip 314, and if the drill bit 14 is within the second size range, the second back clip 334 is coupled to the front clip 314. To couple either the first back clip 330 or the second back clip 334 to the front clip 314, the posts 322 of the front clip 314 are aligned with the openings 346*a*, 346*b* of the back clip 318, 330, 334. The back clip 318, 330, 334 is then slid into the recess 50 of the drill bit holding region 46. Simultaneously, as shown in FIG. 27, the tabs 342*a*, 342*b* of the back clip 318, 330, 334 pass over the ratchet teeth 326 of the posts 322. As the tabs 342*a*, 342*b* pass the individual ratchet teeth 326, the ratchet teeth 326 inhibit the back clip 318, 330, 334 from moving back up along the posts 322.

Figure 28:
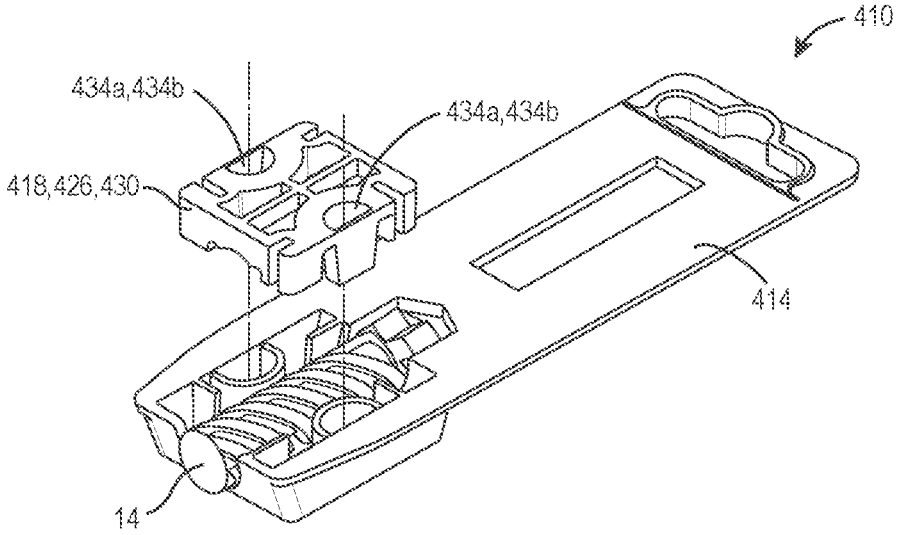
FIG. 28 is an exploded view of a packaging assembly according to another embodiment.
Figure 29:
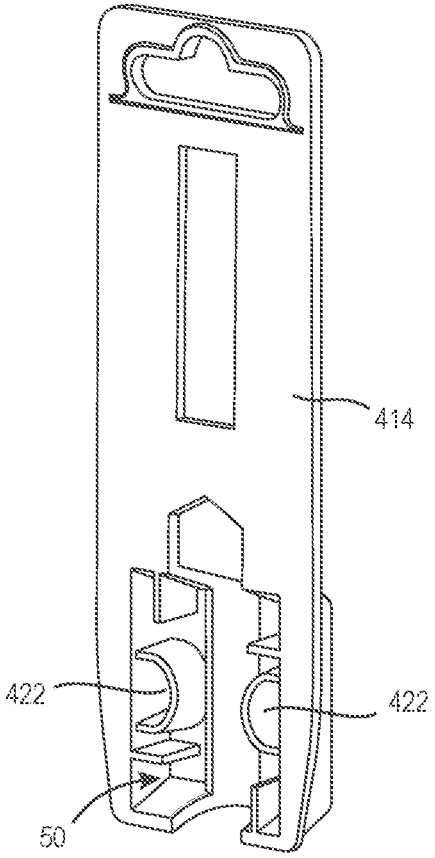
FIG. 29 is a perspective view of a front clip of the packaging assembly of FIG. 28.

FIG. 28 illustrates a packaging assembly 410 according to another embodiment of the invention. The packaging assembly 410 is similar to the packaging assembly 110, with like features being represented with like reference numerals. The packaging assembly 410 includes a front clip 414 and a back clip 418. As shown in FIG. 29, the front clip 414 is similar to the front clip 114, but includes a pair of wells 422 positioned within the recess 50.

Figure 30:
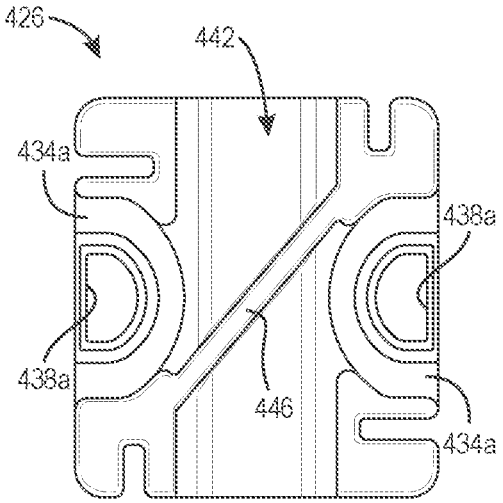
FIG. 30 is a rear view of a first back clip of the packaging assembly of FIG. 24.
Figure 31:
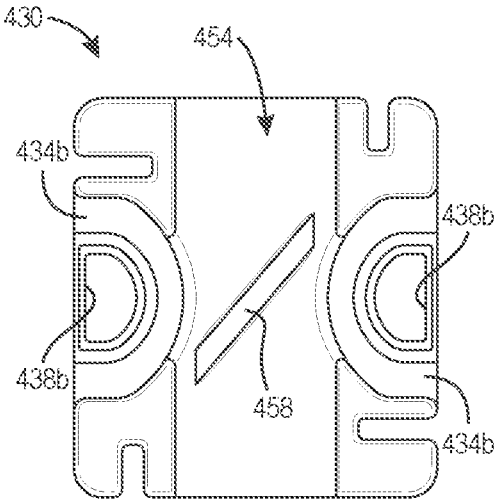
FIG. 31 is a rear view of a second back clip of the packaging assembly of FIG. 24.
Figure 32:
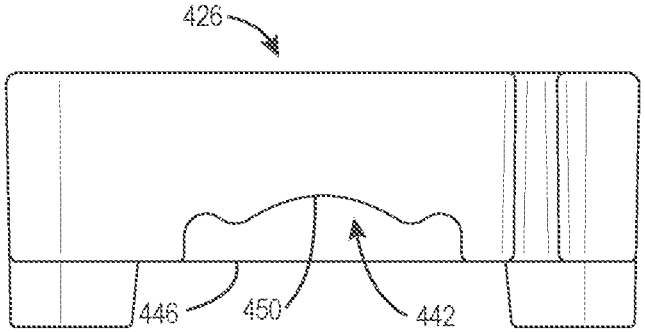
FIG. 32 is a side view of the first back clip of FIG. 30.
Figure 33:
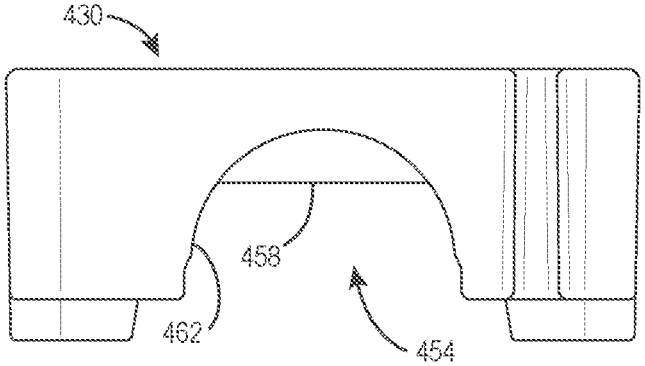
FIG. 33 is a side view of the second back clip of FIG. 31.
Figure 34:
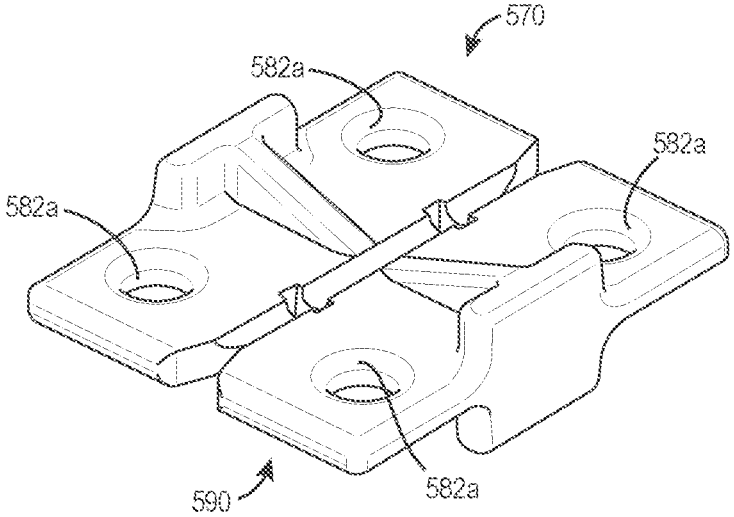
FIG. 34 is a perspective view of an alternative second back clip of the packaging assembly of FIG. 1.
Figure 35:
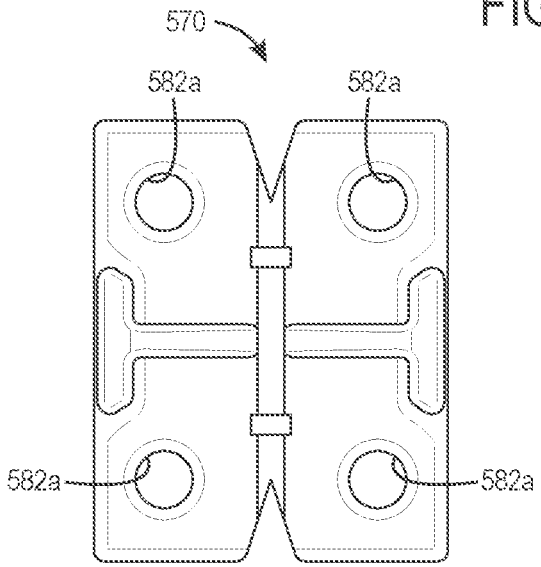
FIG. 35 is a front view of the second back clip of FIG. 34.
Figure 36:
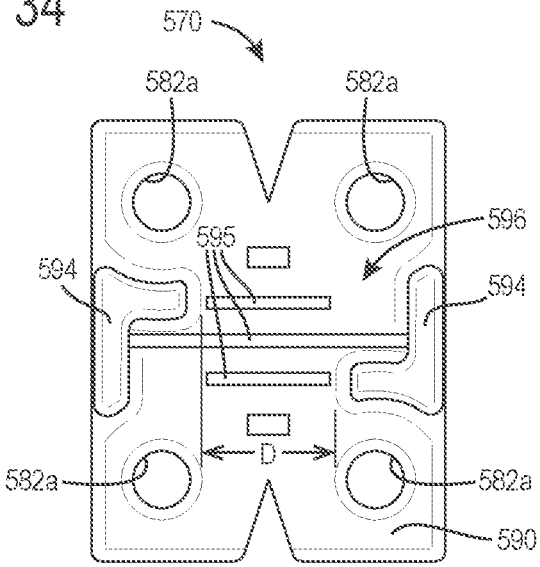
FIG. 36 is a rear view of the second back clip of FIG. 34.
Figure 37:
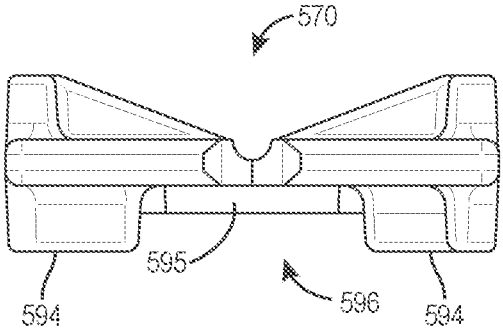
FIG. 37 is a side view of the second back clip of FIG. 34.
Figure 38:
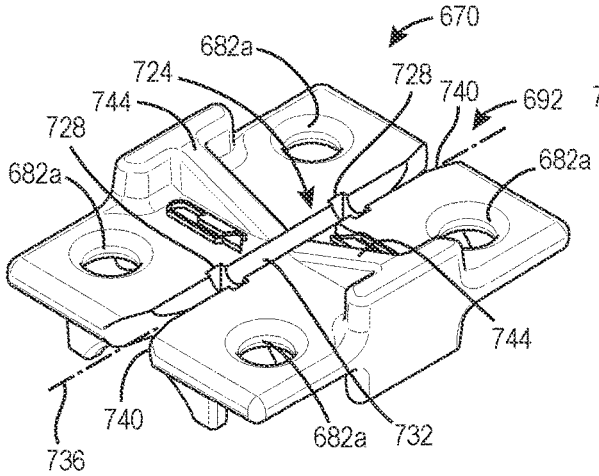
FIG. 38 is a front perspective view of an alternative second back clip of the packaging assembly of FIG. 1.
Figure 39:
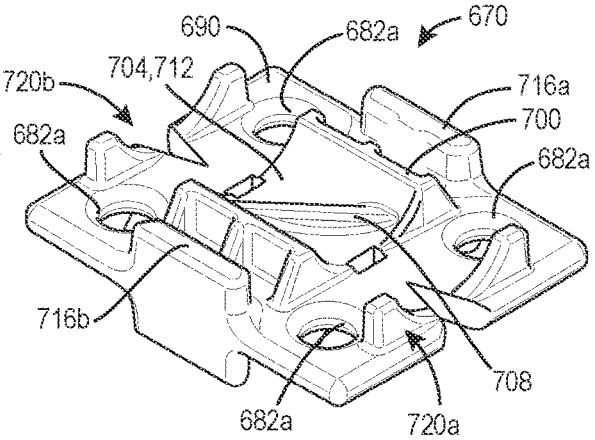
FIG. 39 is a rear perspective view of the second back clip of FIG. 38.
Figure 40:
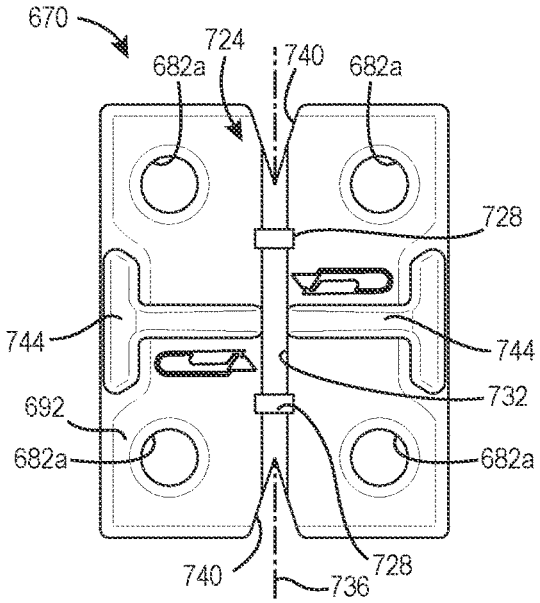
FIG. 40 is a front view of the second back clip of FIG. 38.
Figure 41:
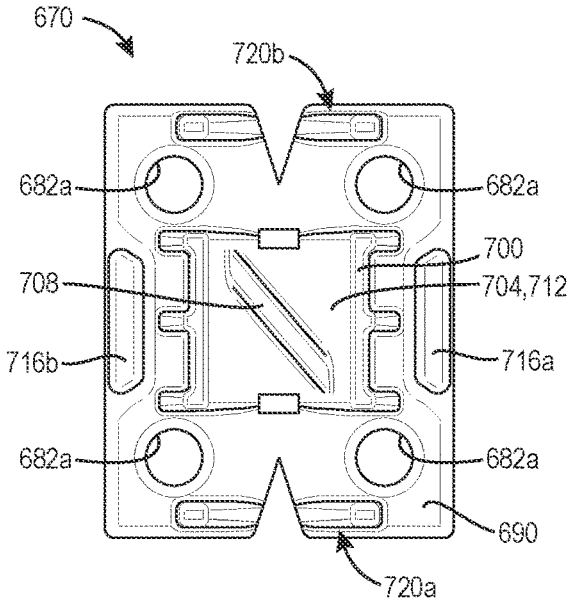
FIG. 41 is a rear view of the second back clip of FIG. 38.
Figure 42:
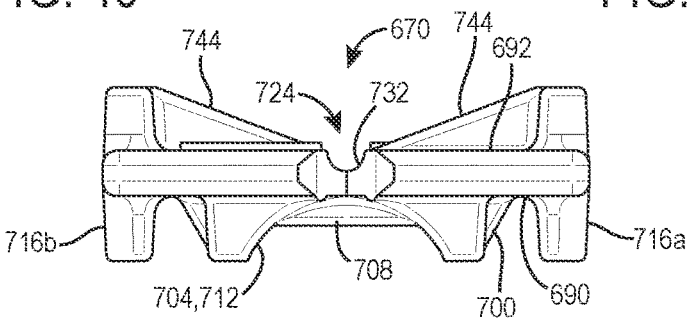
FIG. 42 is a side view of the second back clip of FIG. 38.

Similar to the back clip 118 described above, the back clip 418 may either be a first back clip 426 (FIG. 30) or a second back clip 430 (FIG. 31). The first back clip 426 may be used to protect drill bits 14 that fall within the first size range. The second back clip 430 may be used to protect drill bits 14 that fall within the second size range. The first back clip 426 includes a pair of wells 434*a*. The wells 434 define well apertures 438*a* that extend through the first back clip 426. The first back clip 426 further defines a channel 442 with a ridge 446 that extends through the channel 442 at an oblique angle to correlate with a flute of a drill bit 14. The channel 442 defines an arcuate surface 450 having a first radius that correlates to the first size range of drill bits 14.

The second back clip 430 is similar to the first back clip 426 and also includes a pair of wells 434*b* that define well apertures 438*b*. The second back clip 430 further defines a channel 454 with a ridge 458 that extends partially through the channel 454 at an oblique angle to correlate with a flute of a drill bit 14. The channel 454 defines an arcuate surface 462 having a second radius that correlates to the second size range of drill bits 14. The channel 454 extends deeper into the second back clip 430 than the channel 442 extends into the first back clip 426 to accommodate drill bits 14 with larger diameters.

Assembly of the packaging assembly 410 is similar to the assembly of the packaging assembly 110 described above. A drill bit 14 is seated within the channel 54 of the drill bit holding region 46 of the front clip 414 with the tip end of the drill bit 14 extending into the window 62. Then, depending on the size of the drill bit 14, either the first back clip 426 or the second back clip 430 is coupled to the front clip 414. Specifically, if the drill bit 14 is within the first size range, the first back clip 426 is coupled to the front clip 414, and if the drill bit 14 is within the second size range, the second back clip 430 is coupled to the front clip 414. To couple either the first back clip 426 or the second back clip 430 to the front clip 414, the wells 434 of the back clip 418, 426, 430 are aligned with the wells 422 of the front clip 414. The back clip 418, 426, 430 is then inserted into the recess 50 of the drill bit holding region 46. An adhesive is then introduced into the wells 434 of the back clip 418, 426, 430. The adhesive flows through the well apertures 438 to the bottom of the wells 422 of the front clip 414. The adhesive hardens and secures the back clip 418, 426, 430 to the front clip 414.

FIGS. 34-37 illustrate an alternative second back clip 570 to be used with the packaging assembly 10 described above. The second back clip 570 is similar to the second back clip 70 with like features being represented with like reference numbers plus "500". The second back clip 570 also includes a plurality of apertures 582*a*. An interior side 590 of the second back clip 570 includes a set of ridges 594 that define a channel 596 therebetween. A plurality of ribs 595 extend between the set of ridges 594 in a crosswise direction of the second back clip 570. The ribs 595 may engage a flute to position and secure the drill bit 14 within the packaging assembly 10. Alternatively, the ribs 595 may contact or engage an outer surface of the drill bit 14. The channel 596 defines a distance D between the ridges 594. The distance D correlates to the second size range of drill bits 14. In other words, the channel 596 defines a surface 598 that correlates to the drill bits 14 within the second size range. The second back clip 570 may be used interchangeably with the second back clip 70 described above in the packaging assembly 10. In other embodiments, the packaging assembly 10 may include an alternative first back clip that is similar to the second back clip 570. The alternative first back clip may include ridges that define a channel therebetween. The distance between the ridges may be smaller to correspond to drill bits 14 with a smaller diameter than the drill bits 14 within the second size range. As such, the distance D between the ridges may vary.

FIGS. 38-42 illustrate an alternative second back clip 670 to be used with the packaging assembly 10 described above. The second back clip 670 is similar to the second back clip 70 with like features being represented with like reference numbers plus "600". The second back clip 670 also includes a plurality of apertures 682*a* that extend between an interior side 690 and an exterior side 692. An interior side 690 of the second back clip 670 includes a drill seat 700 that extends from the second back clip 670 to define a channel 704. The channel 704 includes a ridge 708 that extends partially through the channel 704 at an oblique angle to correlate with a flute of a drill bit 14. The ridge 708 may engage a flute to position and secure the drill bit 14 within the packaging assembly 10. Alternatively, the ridge 708 may contact or engage an outer surface of the drill bit 14. The channel 704 defines an arcuate surface 712 having a radius that correlates to the second size range of drill bits 14. The interior side 690 also includes a first set of ribs 716*a*, 716*b* that help position the second back clip 670 relative to the front clip 18 and a second set of ribs 720*a*, 720*b* that help position the drill bit 14 within the channel 704.

The exterior side 692 includes a recess 724 having a pair of openings 728 that extend between the interior side 690 and the exterior side 692. The recess 724 and the openings 728 define a score line 732 or a fracture zone that extends along a longitudinal axis 736 of the second back clip 670. Slits 740 extend into the second back clip 670 at opposing ends of the score line 728. The score line 732, the openings 728, and the slits 740 assist in removing the drill bit 14 from the packaging assembly 10. Specifically, a user may use a tool (e.g., a knife, screwdriver, etc.) to fracture or separate the second back clip 670 along the longitudinal axis 736 into two pieces. Alternatively, a user may apply pressure to a pair of inclined ribs 744 to separate the second back clip 670 along the score line 732. Once the second back clip 670 is fractured, a user may apply pressure to the inclined ribs 744 to gain access to the drill bit holding region 46 of the front clip 18 and remove the drill bit 14 from the packaging assembly 10.

The second back clip 670 may be used interchangeably with the second back clip 70 described above in the packaging assembly 10. In other embodiments, the packaging assembly 10 may include an alternative first back clip that is similar to the second back clip 670. The alternative first back clip may include a drill seat that defines a channel. The channel may have an arcuate surface having a radius that corresponds to drill bits 14 with a smaller diameter than the drill bits 14 within the second size range. The alternative first back clip may also include a recess that defines a score line.

FIGS. 43-46 illustrate a packaging assembly 810 according to another embodiment of the invention. The packaging assembly 810 is similar to the packaging assembly 10 described above with like features being represented with like reference numerals. The packaging assembly 810 includes a front clip 814 and a back clip 818. Generally, the front clip 814 is similar to the front clip 18 and includes a drill bit holding region 46 with a channel 54 for a drill bit 14 and a plurality of posts 58 extending away from the drill bit holding region 46. The back clip 818 may be similar to the first back clip 66 or the second back clips 70, 570, 670 discussed above. As such, the back clip 818 may either be used to protect drill bits within the first size range or used to protect drill bits that fall within the second size range. The back clip 818 includes a plurality of apertures 822 extending through the back clip 818. In the illustrated embodiment, the back clip 818 includes four apertures 822. Each of the four apertures 822 is linearly aligned with two adjacent apertures 822. In other words, the apertures 822 are arranged in a rectangular pattern. The apertures 822 are sized to receive the posts 58 of the front clip 18 when the packaging assembly 10 is assembled. In other embodiments, the back clip 818 may include more or less than four apertures 822. In such an embodiment, the front clip 814 may include the same amount of posts 58 as apertures 822 on the back clip 818. In further embodiments, the back clip 818 may include a plurality of posts 58 that are received in a plurality of apertures in the front clip 814.

Figure 44:
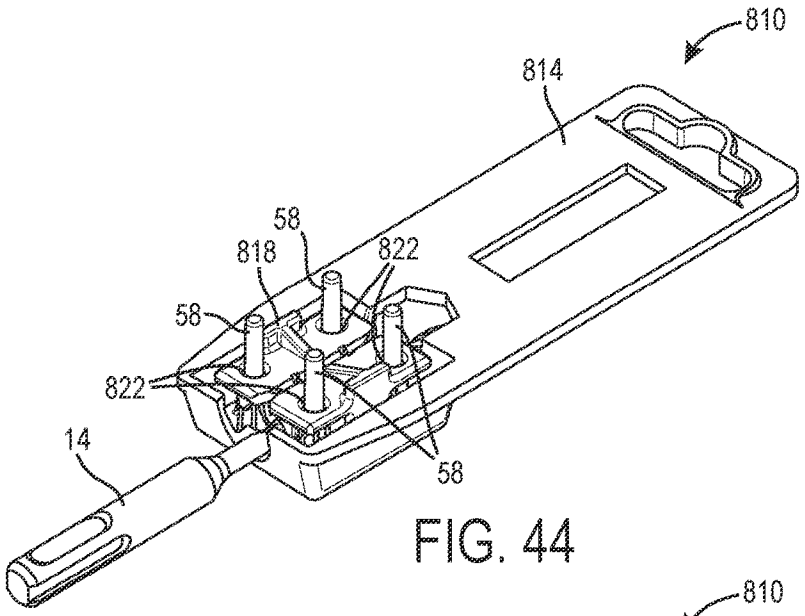
FIG. 44 is a perspective view of the packaging assembly of FIG. 43 partially assembled.
Figure 43:
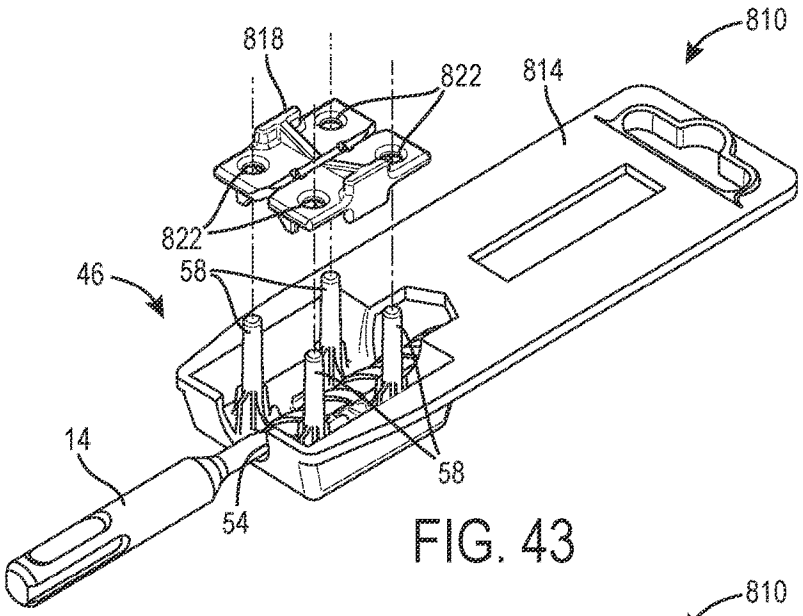
FIG. 43 is an exploded view of a packaging assembly according to another embodiment.
Figure 46:
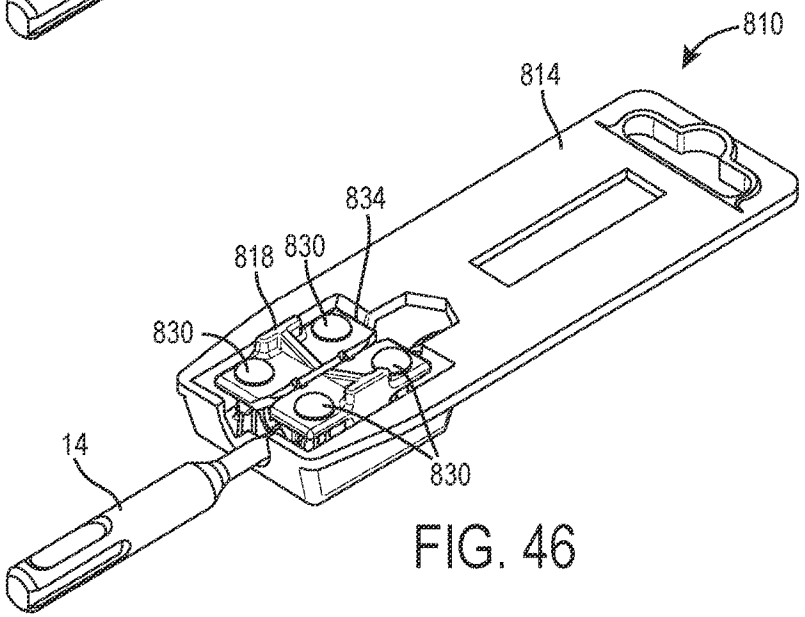
FIG. 46 is a perspective view of the packaging assembly of FIG. 43 assembled.
Figure 45:
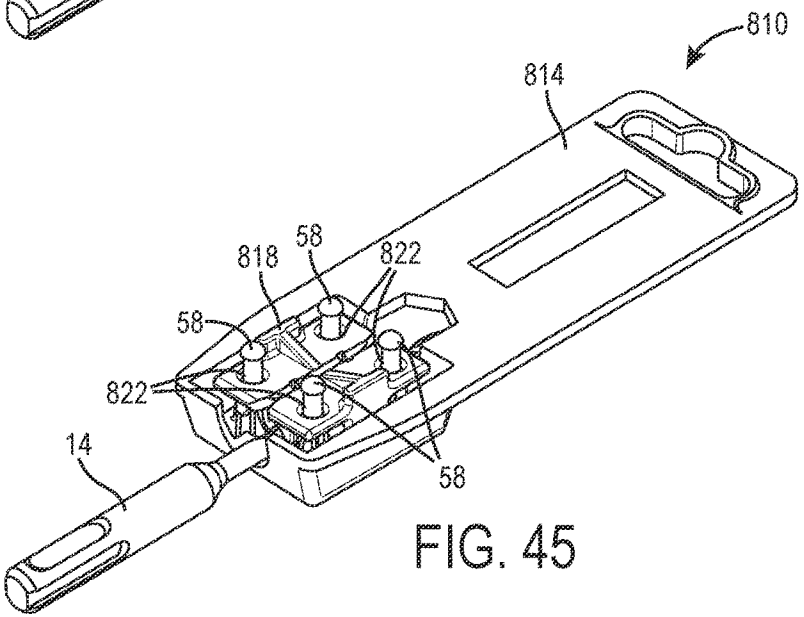
FIG. 45 is another perspective view of the packaging assembly of FIG. 43 partially assembled.

To assemble the packaging assembly 810, the drill bit 14 is seated within the channel 54 of the drill bit holding region 46 of the front clip 814. Then, the apertures 822 of the back clip 818 are aligned with the posts 58 of the front clip 814 as the back clip 818 is positioned over the drill bit 14 within the drill bit holding region 46 to cover the drill bit 14 (FIG. 44). Next, localized vibration is applied to each of the posts 58 to melt the posts 58 (FIG. 45). As the localized vibrations are applied to the posts 58, the posts 58 begin to melt, creating pools of melted material 826 (e.g., melted plastic) that cover the apertures 822 of the back clip 818 (FIG. 46). The pools of melted material 826 are then cooled, either naturally or by a cooling process. As the melted material 826 cools, the melted material 826 begins to harden and the posts 58 of the front clip 814 begin to fuse with the back clip 818 to secure the drill bit 14 within the drill bit holding region 46. Meanwhile, as the pools of melted material 826 cool, an enlarged, melted head 830 is formed at an end of the posts and positioned on a top side 834 of the back clip 818 to inhibit axial movement of the back clip 818 relative to the front clip 814 along the posts 58, which inhibits removal of the back clip 818 from the front clip 814. As such, the enlarged melted head 830, may be integral with the posts 58. When the pools of melted material 826 are fully hardened, the drill bit 14 is secured within the packaging assembly 810 and protected from unwanted damage.

Although the invention is described with reference to discrete embodiments of a packaging assembly, variations of the packaging assemblies exist within the spirit and scope of the invention. For example, in some embodiments, a packaging assembly may only include one size of back clip or may include a different back clip for each size of drill bit.

Various features and advantages of the invention are set forth in the following claims.

What is claimed is:

1. A packaging assembly for a drill bit, the packaging assembly comprising:

a front clip including a front side, a rear side opposite the front side, and a drill bit holding region defining a recess, the recess configured to receive a portion of the drill bit, the front clip further including a post extending from the recess; and a back clip that is separate from the front clip, the back clip including an aperture that receives the post;

wherein the post includes an enlarged, melted head to inhibit axial movement of the back clip relative to the front clip, and wherein the drill bit holding region protrudes from the front side of the front clip to define the recess.

2. The packaging assembly of claim 1, wherein the back clip is a first back clip that is configured to hold a first size range of drill bits, and the packaging assembly further includes a second back clip that can alternatively be secured to the front clip to hold the drill bit within the channel, the second back clip is configured to hold a second size range of drill bits, the first size range is different than the second size range.

3. The packaging assembly of claim 1, wherein the post is a first post, and wherein the front clip further includes a second post extending from the recess.

4. The packaging assembly of claim 3, wherein the aperture is a first aperture, and wherein the back clip includes a second aperture that receives the second post.

5. The packaging assembly of claim 1, wherein the front clip further includes a hanging aperture configured to support the packaging assembly from a hook.

6. The packaging assembly of claim 1, wherein the front clip further includes a window extending between the front and rear sides, wherein the window is adjacent the drill bit holding region.

7. The packaging assembly of claim 1, wherein the post is formed of plastic.

8. A packaging assembly for a drill bit, the packaging assembly comprising:

a first clip including a front side, a rear side opposite the front side, and an aperture extending through the front and rear sides; and a second clip that is separate from the first clip, the second clip including a front side, a rear side opposite the front side, a drill bit holding region, the drill bit holding region defining a recess, the recess configured to receive a portion of the drill bit, and a post extending from the recess, the post being received by the aperture, the post including an enlarged, melted head fused to the first clip to inhibit removal of the first clip from the second clip and secure the drill bit between the first and second clips, wherein the drill bit holding region protrudes from the rear side of the second clip to define the recess.

9. The packaging assembly of claim 8, wherein the first clip includes a channel to receive the drill bit.

10. The packaging assembly of claim 8, wherein the enlarged, melted head covers the aperture.

11. The packaging assembly of claim 8, wherein at least a portion of the second clip is composed from plastic.

12. The packaging assembly of claim 8, wherein the post is a first post, and wherein the second clip includes a second post extending from the recess.

13. The packaging assembly of claim 12, wherein the aperture is a first aperture, and wherein the first clip includes a second aperture to receive the second post.

* * * * *